US006865355B2

(12) United States Patent
Burkes et al.

(10) Patent No.: US 6,865,355 B2
(45) Date of Patent: Mar. 8, 2005

(54) PRINTING APPARATUS AND METHOD FOR MONOCHROME MODE AND COLOR MODE SWITCHING

(75) Inventors: Theresa A. Burkes, Meridian, ID (US); John M. Bagley, Jr., Meridian, ID (US); Darryl Richter, Eagle, ID (US); Scott S. Lee, Meridian, ID (US); Darren E. Binder, Boise, ID (US); Michael B. Lloyd, Meridian, ID (US); Lisa Johnson, Boise, ID (US); Kari E. Castleberry, Hidden Springs, ID (US); Mark Irwin, Middleton, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/402,112

(22) Filed: Mar. 28, 2003

(65) Prior Publication Data

US 2004/0190926 A1 Sep. 30, 2004

(51) Int. Cl.[7] ..... G03G 15/00

(52) U.S. Cl. ..... 399/85; 399/82

(58) Field of Search ..... 399/1, 75, 82, 399/85, 367, 401

(56) References Cited

U.S. PATENT DOCUMENTS 5,655,208 A * 8/1997 Sahay et al. ..... 399/401 X
5,884,120 A * 3/1999 Ito et al. ..... 399/85 X
5,893,020 A * 4/1999 Atsumi ..... 399/401 X
6,029,023 A * 2/2000 Munemori et al. ..... 399/82 X
6,263,173 B1 * 7/2001 Nakamura et al. ..... 399/82

* cited by examiner

*Primary Examiner*—Sandra L. Brase

(57) ABSTRACT

A printing method for printing of a print job by a printing apparatus having a monochrome mode and a full-color mode. The method may include examining a portion of the print job to determine whether the portion includes a color page, and if the portion includes a color page, scheduling printing of a first page of the portion and one or more subsequent pages of the print job in a full-color mode, irrespective of the color content of the one or more subsequent pages.

22 Claims, 4 Drawing Sheets

PRINTING APPARATUS AND METHOD FOR MONOCHROME MODE AND COLOR MODE SWITCHING

BACKGROUND

Color laser in-line printers typically have distinct color and monochrome print modes, each of which may be capable of printing pages at equal speed. Monochrome pages may typically be printed in either the monochrome or full-color mode, while color pages may be printed only in the full-color mode. Printing monochrome pages in the full-color mode may increase wear on consumables within the printer, such as toner cartridges, print drums, etc. For this reason, one type of printer prints each color page of a print job in the full-color print mode and each monochrome page in the monochrome print mode. However, switching print modes between pages of the print job in this manner may cause delay and additional wear on printer parts and consumables.

SUMMARY

A printing method for printing of a print Job by a printing apparatus having a monochrome mode and a full-color mode. The method includes examining a portion of the print job to determine whether the portion includes a color page, and if the portion includes a color page, scheduling printing of a first page of the portion and one or more subsequent pages of the print job in a full-color mode, irrespective of the color content of the one or more subsequent pages.

DETAILED DESCRIPTION

Figure 1:
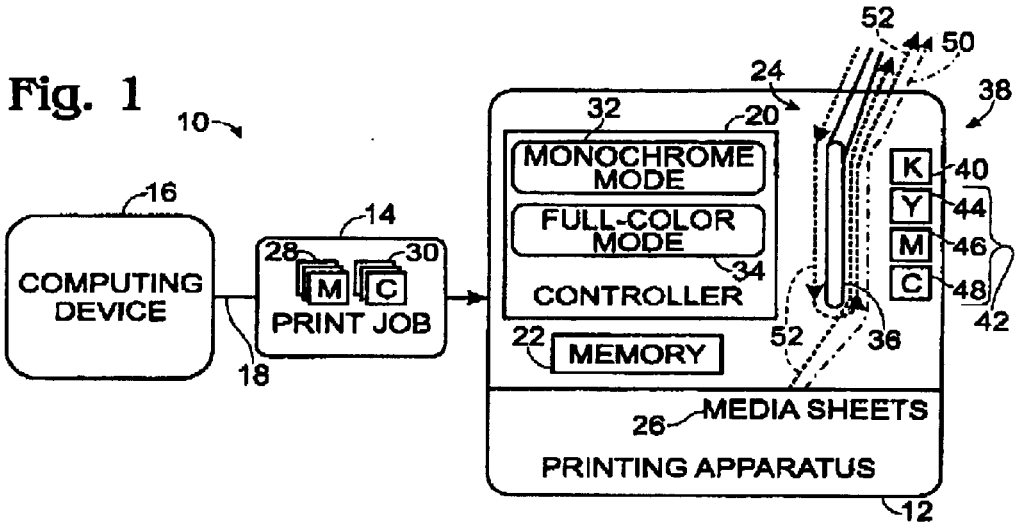
FIG. 1 is a schematic view of a printing system according to one embodiment of the present invention.

FIG. 1 shows generally a printing system 10, including a printing apparatus 12 configured to receive a print job 14 from a computing device 16 received via a communication link 18. As indicated, the printing apparatus may include a controller 20, memory 22, and a print mechanism 24. The controller typically is configured to receive the print job into memory and to direct the print mechanism to print the pages of the print job on sheets of media 26, such as paper.

Print job 14 may include monochrome pages 28 and/or color pages 30. The term "monochrome page" as used herein refers to grayscale and/or black-and-white pages, printed using only black toner or ink. The term "color page" as used herein refers to any page containing non-black or non-grayscale content. Thus, a page containing only purple and white is a color page, while a page containing only black and white is a monochrome page. Controller 20 is configured to perform a color mode switching decision to select either a monochrome mode 32 or a full-color mode 34 in which to print each page of the print job.

Print mechanism 24 typically includes an electrostatic belt 36 configured to drive print media 26 across a plurality of print cartridges 38, which apply ink or toner to the print media to produce the printed image. Typically, a black print cartridge 40 and one or more color print cartridges 42 are provided. In the depicted embodiment a cyan print cartridge 48, a magenta print cartridge 46, and a yellow print cartridge 44 are arranged in a line along the travel path of the media. Printing apparatuses that include print cartridges arranged in this manner are referred to as "in-line" color printers. It will be appreciated that other print mechanisms may also be used, such as print mechanisms that include a color print cartridge having cyan, magenta, and yellow elements combined in a single print cartridge, or print mechanisms that rotate print media around a print drum for multiple rotations, each rotation applying a separate color to the print media.

In full-color mode 34, print mechanism 24 is configured to print both color pages 30 and monochrome pages 28, using both black print cartridge 40 and color print cartridges 42. In monochrome mode 32, print mechanism 24 is configured to print monochrome pages 28, using only black print cartridge 40. It will be appreciated that while it is possible to erroneously print color pages 30 in the monochrome mode, this will result in the color pages being printed in grayscale.

Print apparatus 12 typically is configured to print single-sided media sheets in a simplex mode and double-sided media sheets in a duplex mode. In the simplex mode, media sheets 26 travel on belt 36 along a simplex path 50, such that only one side of the media sheet travels past the print cartridges 38. In the duplex mode, the media sheets 26 travel on belt 36 along a duplex path 52, such that a first side of media 26 passes print cartridges 38 in a first pass, and a second side of media 26 passes by print cartridges 38 on a second pass. In between the first and second passes, the media sheet is flipped at position 26' such that the printed side of the media sheet sticks to the belt as the media sheet travels around the back side of belt 52. It will be appreciated that printing mechanisms utilizing other simplex and duplex paths may also be utilized. Depending on the configuration of belt 36, the duplex path may differ in length, often expressed in terms of the number of pages in the duplex path at any one time. Since duplex pages are printed in pairs, the duplex path is typically an even number of pages in length, such as two, four, six or more pages. Although print apparatus 12 does not switch color modes while printing a duplex path group, other embodiments of a printing apparatus may be configured to do so.

Figure 2:
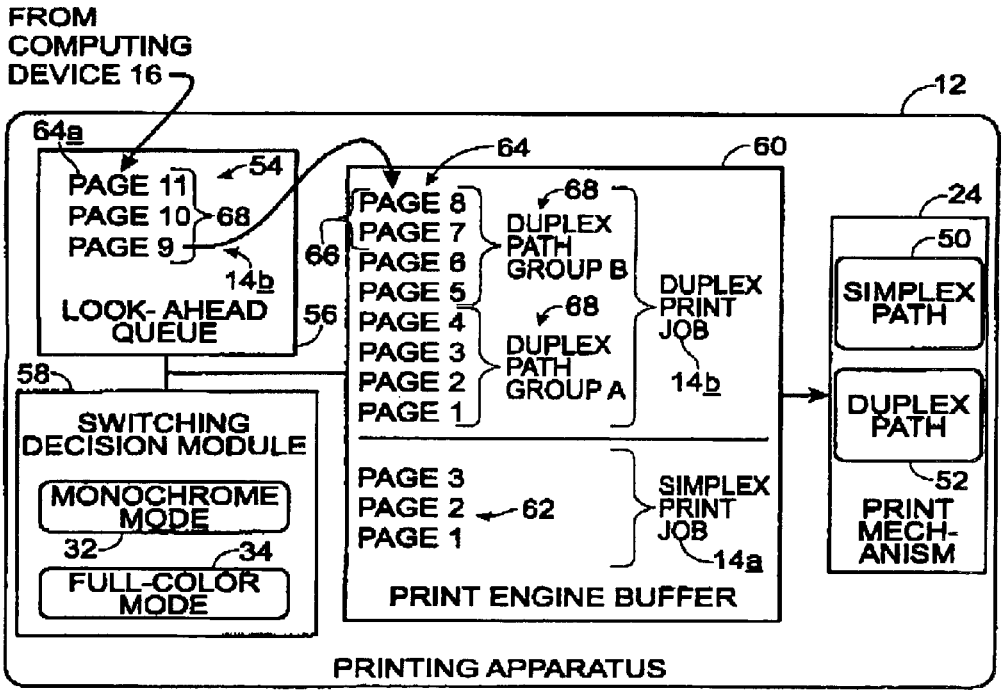
FIG. 2 is a schematic view showing the workflow of pages of a print job through the printing device of FIG. 1.

As shown in FIG. 2, a stream of incoming pages 54 of a print job are received in a look-ahead queue 56 of printing apparatus 12, where they are examined for color content by switching decision module 58, before being passed to print engine buffer 60. Thus, the number of pages in the look-ahead queue depends on the speed at which they are received from the computing device 16, and the backlog in print engine buffer 60.

Switching decision module 58 is configured to examine the color content of pages 54 stored in the look-ahead queue, and to make color mode switching decisions, i.e., decisions on whether to prepare a page or page range for printing in full-color mode 34 or monochrome mode 32. Print jobs may be passed to the printing device either as simplex print jobs 14*a* or as duplex print jobs 14*b*. Alternatively, the printing apparatus may be configured to print both simplex portions and duplex portions in the same print job.

Simplex print job 14*a* typically includes a plurality of simplex pages 62, which may include monochrome pages 28 and/or color pages 30. Simplex pages 62 are printed by print mechanism 24 using simplex path 50. Duplex print job 14*b* typically includes a plurality of duplex pages 64, which may be either monochrome pages 28 or color pages 30, and which are printed using duplex path 52. Duplex jobs having an odd number of pages also typically include a final single sided page, referred to as a "singleton page" 64*a*.

The duplex pages are grouped in duplex pairs 66, which print on the front side and back side of a sheet of media 26. One or more duplex pairs 66 may be grouped to form a duplex path group 68. The size of a duplex path group is typically the number of pages that must cycle through duplex path before the printing apparatus can switch between the monochrome mode and full-color mode. As discussed above, the duplex path may be two, four, six or more pages in length.

As simplex print jobs and duplex print jobs stream through the printing apparatus, the switching decision module is typically configured to perform a switching analysis to determine whether to print the pages in the monochrome or full-color mode. The switching decision module examines the color content of incoming pages 54 stored in the look-ahead queue. The switching decision module is typically programmed to follow the decision logic shown and described in reference to FIG. 3, in order to select the appropriate color mode.

Figure 3:
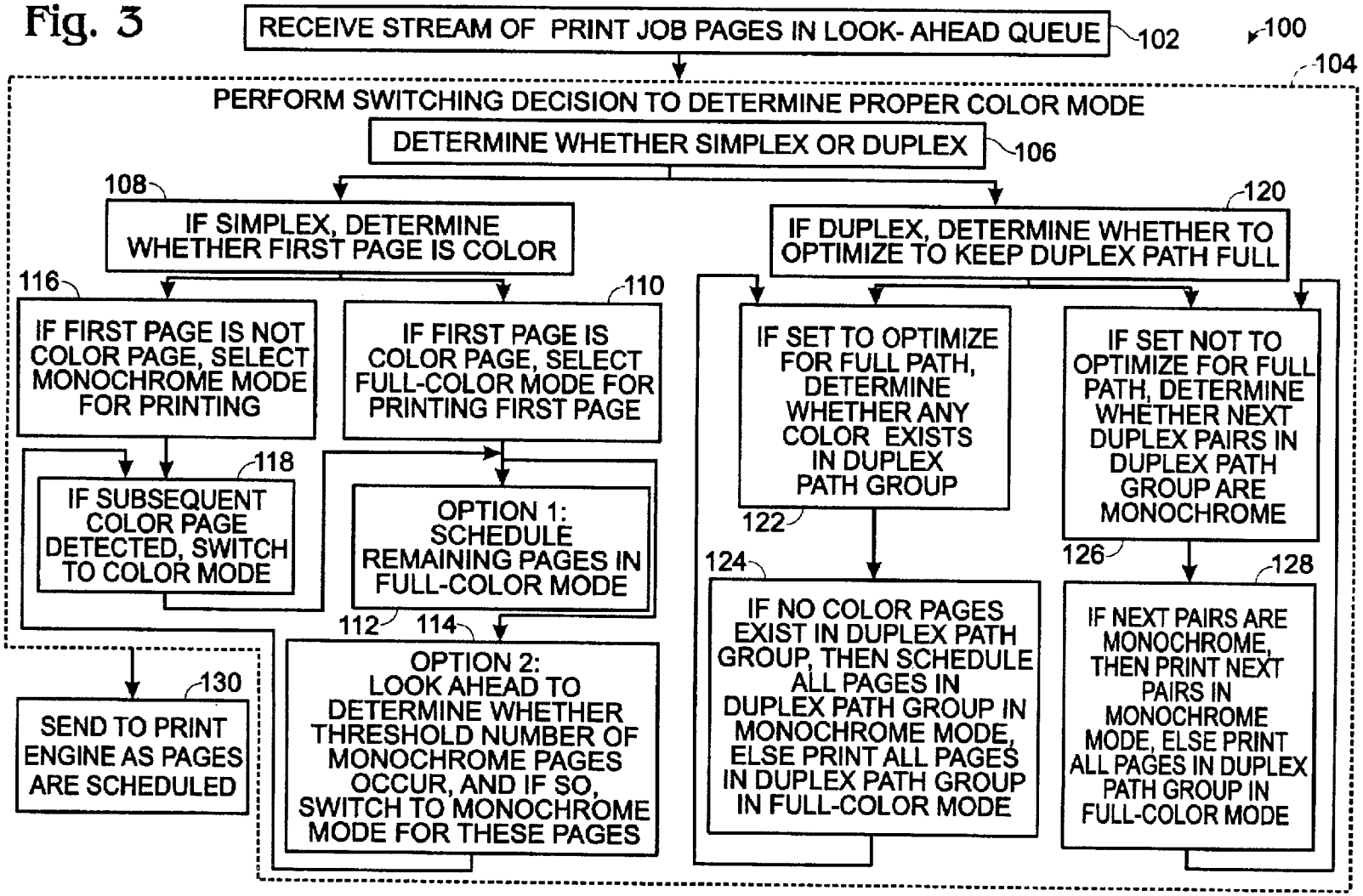
FIG. 3 is a flowchart illustrating a print method according to one embodiment of the present invention.

FIG. 3 shows a method 100 according to one embodiment of the present invention. At 102, incoming pages of a print job are received in a look-ahead queue of a printing apparatus. At 104, the controller performs a switching decision to determine an appropriate color mode in which to schedule pages for printing. At 130, the pages that have been scheduled for printing in the monochrome and/or color modes at 104 are passed to the print engine buffer for processing and printing.

Performing the switching decision may include the steps illustrated at 106–128. At 106, the controller determines whether the print job is a simplex or duplex print job. For printers configured to print both simplex and duplex pages in a single print job, the controller may determine whether a portion of the print job is simplex or duplex, at 106.

Initially considering simplex print jobs, it will be appreciated that steps 108–118 relate to simplex printing. It has been found that the color content of the first page is often a reliable indicator of whether color will appear in a remainder of the print job. For this reason, the controller may initially determine whether a beginning portion of the print job includes a color page or a monochrome page, as indicated at 108. Typically, the beginning portion is a first page of the print job, but it will be appreciated that the beginning portion may be more than one page in length.

If it is determined, at 108, that the first page is a color page, then the full-color mode is selected at 110. Full-color printing may proceed according to one of two options. According to a first option, shown at 112, the switching decision module schedules all remaining pages in the print job to be printed in the full-color mode, irrespective of their actual color content. Thus, subsequent monochrome pages, as well as color pages, may be printed in the full-color mode. According to a second option, shown at 114, the switching decision module may look ahead to determine whether a predetermined threshold number of consecutive monochrome pages appear in the look-ahead queue. If the threshold number of pages is detected, the switching decision module may switch back to the monochrome mode, scheduling the threshold number of pages to be printed in the monochrome mode. If a subsequent color page is detected after the threshold number of pages, the switching decision module typically switches back to the color mode, at 118, and proceeds and repeats option 1, at 112, or option 2 at 114.

If it is determined, at 108, that the first page is not a color page, then the monochrome mode is selected, as shown at 116. After selecting the monochrome mode, the switching decision module schedules the first page and upcoming monochrome pages to be printed in the monochrome mode. If a subsequent color page is detected in the print job, the switching decision module switches to the full-color mode from the monochrome mode, as shown at 118. After switching to the full-color mode, the switching decision module may schedule the color pages for printing in the full-color mode.

Once in the full-color mode (either selected at 110 or 118), printing may proceed according to either the first or second option discussed above, that is, either by printing all remaining pages of the print job in the full-color mode, as shown at 112, or by looking ahead and switching to the monochrome mode if a threshold number of monochrome pages exist, as shown at 114. Thus, steps 108–118 enable detection of the color content of a first page of a print job, and selection of one or more color modes for a remainder of the print job based on the color content of the first page, for simplex print jobs.

Figure 4:
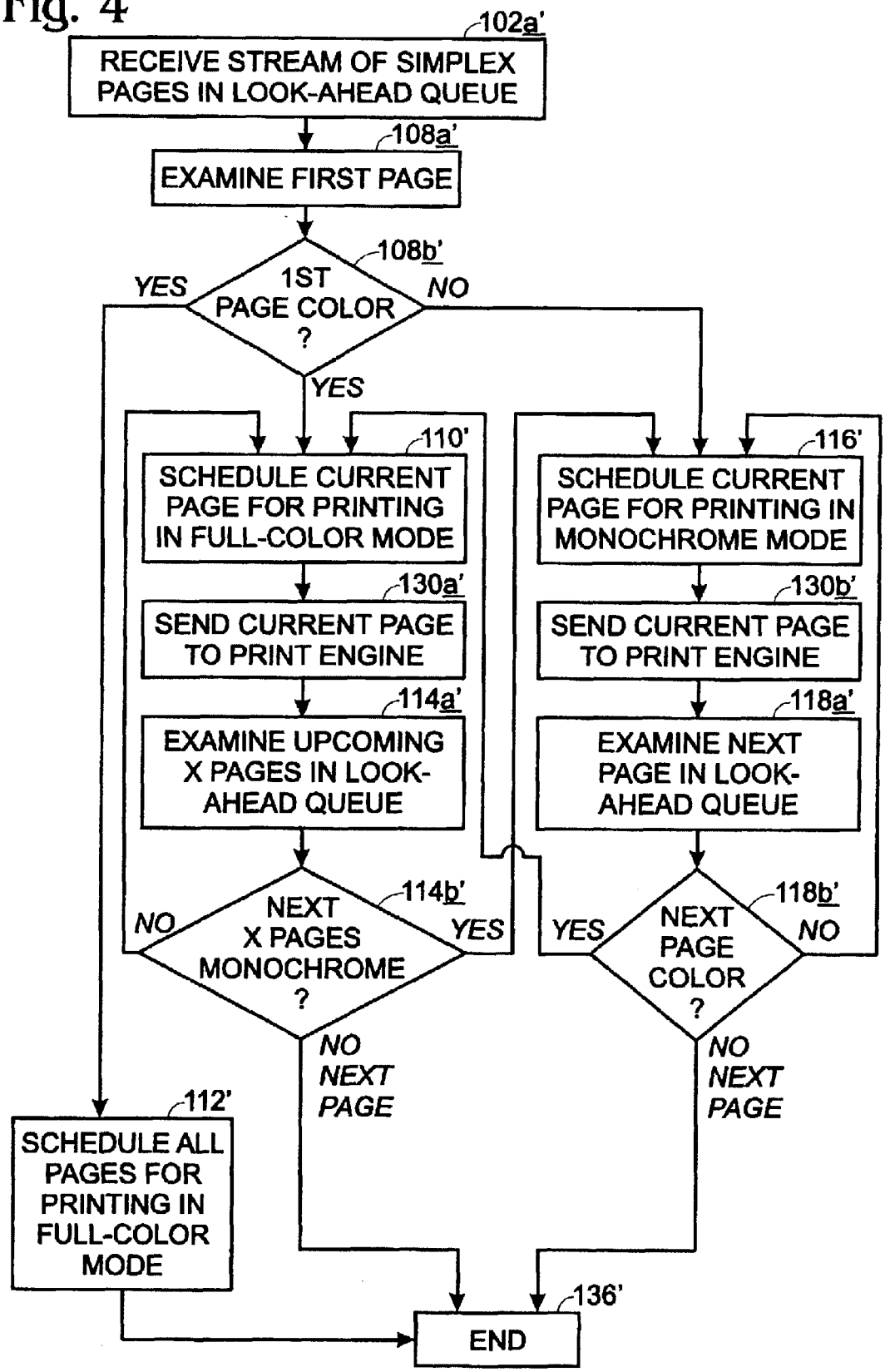
FIG. 4 is a flowchart of a portion of the method of FIG. 3 relating to simplex printing.

The aspects of method 100 related to simplex printing are illustrated in more detail in FIG. 4. As shown at 102*a*' the method initially receives a stream of simplex pages of a print job into look-ahead queue 56. As shown at 108*a*', the switching decision module may examine a beginning portion (typically the first page) of the print job and, as shown at 108*b*', may determine whether the beginning portion includes color. If a color page is identified in the beginning portion, the switching decision module may schedule printing of the beginning portion and all remaining pages of the print job in the full-color mode, as indicated at 112'. Alternatively, the switching decision module may schedule printing only of the beginning portion in the full-color mode, as shown at 110'. It will be appreciated that the beginning portion is typically the first page of the print job, but alternatively may be two or more pages in length. For simplicity, a beginning portion including only the first page of the print job will be described below.

Upon scheduling printing of only the first page, the switching decision module typically sends the current page to the print engine buffer 60, and removes it from the look-ahead queue 56, as shown at 130*a*'. As shown at 114*a*', the switching decision module typically examines upcoming X (a predetermined threshold number) number of pages in look-ahead queue 56, and as shown at 114*b*', and determines whether the next X pages are monochrome. If the next X pages are not monochrome, the switching decision module schedules printing of the next page in the full-color mode, as indicated at 110'.

If the next X pages are monochrome, the switching decision module schedules printing of the X pages in the monochrome mode, as indicated at 116'. As shown at 130*b*', the switching decision module typically sends the current page to the print engine buffer 60, and removes it from the look-ahead queue 56. At 118*a*', the switching decision module typically examines the next page in the look-ahead queue, and at 118*b*' the switching decision module determines whether the next page is a color page. If it is not a color page, the switching decision module schedules printing of the page in the monochrome mode, repeating 116', 130*b*' and 118*a*'. If the next page is a color page, the switching decision module switches to the full-color printing mode and schedules printing of the page in the full-color mode, as shown in 110', 130*a'* and 114*a'*.

As further shown in FIG. 3, method 100 also includes steps 120–128, which relate to duplex printing. At 120, the switching decision module determines whether to optimize to keep the duplex path full. This typically involves querying an optimization setting and determining whether to prioritize keeping the duplex path full (thus improving throughput speed, but possibly incurring the cost of printing monochrome pages in the color mode), over printing a partially full duplex path (thus enabling more frequent transition between print modes (and corresponding savings of consumables costs associated with printing monochrome pages in the color mode), but possibly slowing throughput speed).

If the printing apparatus is set to optimize for a full duplex path, the switching decision module will determine whether any color pages exist in the duplex path group, at 122. If no color pages exist in the duplex path group, the switching decision module schedules printing of all pages in the duplex path group in the monochrome mode, as shown at 124. If a color page does exist in the duplex path group, then the switching decision module schedules printing of all pages in the duplex path group in the full-color mode.

If the printing apparatus is not set to optimize for a full duplex path, the switching decision module determines whether the two pages of the next duplex pair in the duplex path group are both monochrome pages, at 128. If both pages in the next duplex pair are monochrome, the switching decision module schedules printing of the duplex pair in the monochrome mode. Otherwise, if a color page is detected in the duplex pair, the switching decision module schedules printing of the duplex pair in the full-color mode as shown at 128. Thus, Steps 120–128 enable the present method either to optimize to fill the duplex path, or to switch color modes as soon as practical and print a partially empty duplex path, while switching between the monochrome and full-color modes in a duplex print job.

Figure 5:
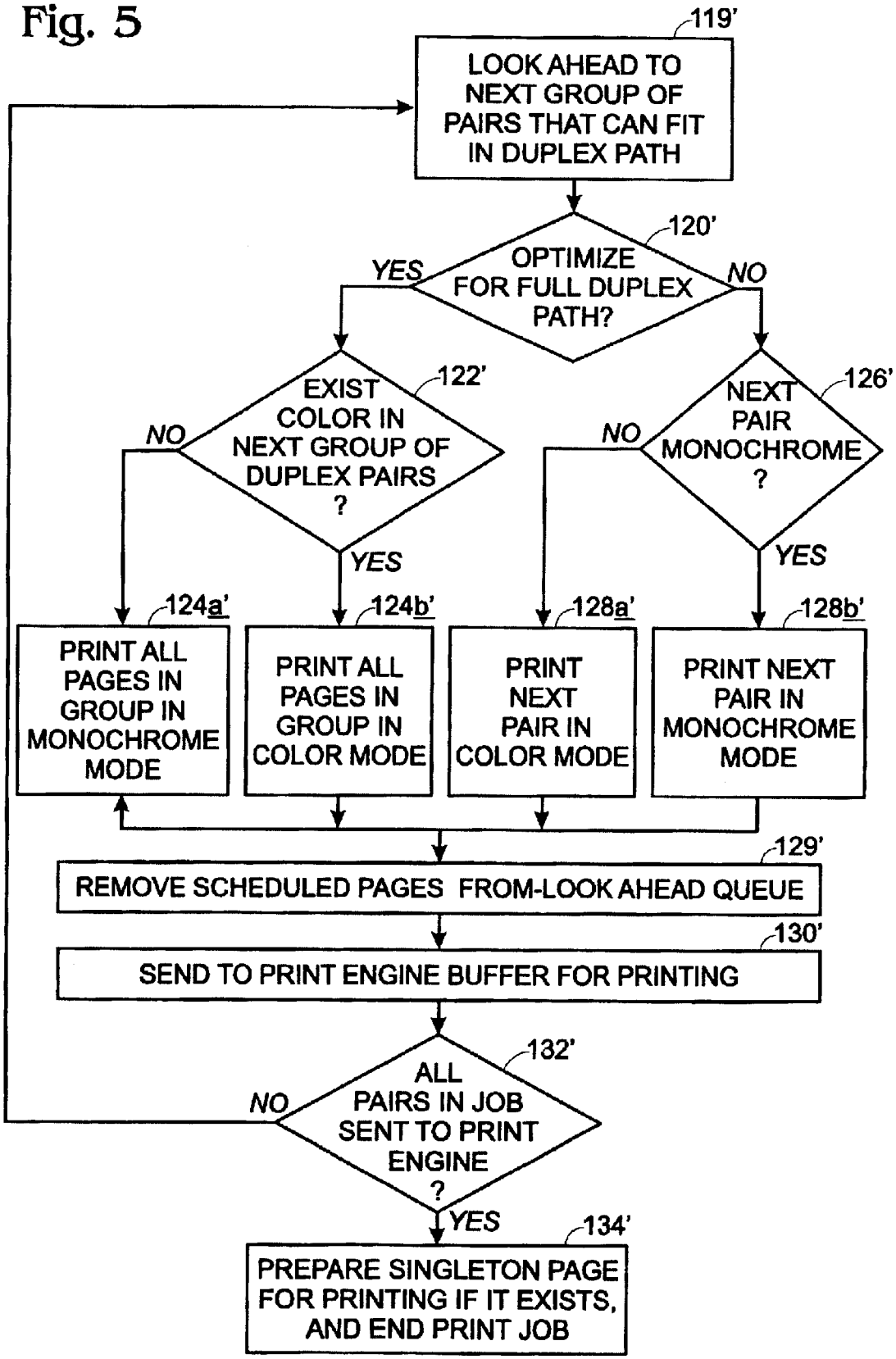
FIG. 5 is a flowchart of a portion of the method of FIG. 3 relating to duplex printing.

The aspects of method 100 related to duplex printing are illustrated in more detail in FIG. 5. Upon determining that duplex printing is called for, the switching decision module looks ahead to the next group of duplex pairs (also referred to herein as a duplex path group) that can fit in the duplex path, at 119'. At 120', the switching decision module determines whether the printing apparatus is configured to optimize to keep the duplex path full. If it is configured to optimize, the switching decision module determines whether there exists any color in the next duplex path group, as shown at 122'. If no color exists, the switching decision module schedules printing of all of the pages in the current duplex path group in the monochrome mode, as indicated at 124*a'*. If color does exist, the switching decision module schedules printing of all of the pages in the current duplex path group for printing in the full-color mode, as indicated at 124*b'*.

If, it is determined at 120', that the printing apparatus is not configured to optimize to keep the duplex path full, the switching decision module determines whether both pages in the next duplex pair are monochrome, as shown at 126'. If both pages in the next duplex pair are monochrome, the switching decision module schedules printing of the pages in the next duplex pair in the monochrome mode, as shown at 128*b'*. If any color is detected in the next duplex pair, the switching decision module schedules printing of both pages in the next duplex pair in the full-color mode, as shown at 128*a'*.

At 129', the scheduled pages are removed from the look-ahead queue and at 130', are sent to the print engine buffer for printing. If all of the duplex pairs have not yet been sent to the print engine buffer, the switching decision module again looks ahead to the next group of duplex pairs in the look-ahead queue, at 119', and determines the appropriate print mode as set forth above. If all of the duplex pairs in the print job have been sent to the print engine, as determined at 132', the switching decision module determines whether any remaining singleton page is a monochrome page or a color page, schedules printing of the singleton page in the appropriate print mode (monochrome or full-color), and ends the print job as shown at 34'.

While the present embodiments have been particularly shown and described, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

What is claimed is:

1. A printing method for printing of a print job by a printing apparatus having a monochrome mode and a full-color mode, the method comprising:

examining a portion of the print job to determine whether the portion includes a color page; and if the portion includes a color page, scheduling printing of a first page of the portion and one or more subsequent pages of the print job in a full-color mode, irrespective of the color content of the one or more subsequent pages;

if the portion does not include a color page, scheduling printing of the portion in a monochrome mode, and if a subsequent color page is detected in a remaining portion of the print job, scheduling printing of the subsequent color page in the full-color mode; and if at least a threshold number of consecutive monochrome cause is detected in a remaining portion of the print job, scheduling printing of the consecutive monochrome pages in the monochrome mode.

2. The printing method of claim 1, wherein the portion is a beginning portion of the print job.

3. The printing method of claim 2, wherein the beginning portion is a first page of the print job.

4. The printing method of claim 1, wherein the one or more subsequent pages include all remaining pages of the print job.

5. A printing method for printing of a print job by a printing apparatus having a monochrome mode and a full-color mode, the method comprising:

examining a portion of the print job to determine whether the portion includes a color page;

if the portion includes a color page, scheduling printing of a first page of the portion and one or more subsequent pages of the print job in a full-color mode, irrespective of the color content of the one or more subsequent pages; and determining whether the print job includes simplex pages or duplex pages;

wherein examining and scheduling are undertaken only if it is determined that the print job includes simplex pages.

6. The method of claim 5, further comprising:

detecting that the print job is a duplex print job, the duplex print job including one or more duplex path groups, each duplex path group including one or more duplex pairs of pages;

determining whether pages in a next duplex pair in the print job includes a color page;

if a color page is detected in the next duplex pair, scheduling the entire duplex path group to print in the full-color made; and if no color page is detected in the next duplex pair, printing the next duplex pairs in the monochrome mode.

7. The method of claim 6, further comprising sending the scheduled pairs to a print engine buffer for printing.

8. The method of claim 7, further comprising determining whether all pairs duplex pairs in the print job have been sent to the print engine buffer, and if not, then:

determining whether pages in a next duplex pair in the print job includes a color page;

if a color page is detected in the next duplex pair, scheduling the entire duplex path group to print in the full-color mode; and if no color page is detected in the next duplex pair, printing the next duplex pair in the monochrome mode.

9. The method of claim 8, further comprising, preparing a singleton page at the end of the print job for printing.

10. A printing method for printing of a duplex print job by a printing apparatus having a monochrome mode, a full-color mode, and a duplex path, the method comprising:

receiving one or more duplex pairs of pages, the duplex pairs belonging to a duplex path group;

determining an optimization setting of the printing apparatus indicating whether the printing apparatus is set to optimize filling the duplex path; and if the printing apparatus is set to optimize filling the duplex path, determining whether any color exists in duplex path group, and, if no color pages exist in duplex path group, scheduling printing of all pages in the duplex path group in the monochrome mode, otherwise, scheduling printing of all pages in the duplex path group in the full-color mode.

11. The method of claim 10, further comprising, if the printing apparatus is not set to optimize filling the duplex path, determining whether a next duplex pair includes only monochrome pages.

12. The method of claim 11, further comprising, if the next duplex pair includes only monochrome pages, then scheduling printing of all pages in the next duplex pair in the monochrome mode, otherwise, scheduling printing of all pages in the next duplex pair in full-color mode.

13. A printing method for use by a printing apparatus, the method comprising:

determining whether a print job as a simplex print job or a duplex print job; and if the print job is a simplex print job, then:

determining whether a beginning portion of the print job includes any color pages;

if the beginning portion doesn't include any color pages, then:

(a) scheduling printing of the beginning portion of the print job in the monochrome mode;

(b) scheduling a plurality of remaining pages of the print job to print in the monochrome mode; and (c) if a color page is detected in the plurality of remaining pages, then switching to the color mode and scheduling the detected color page and subsequent pages of the print job to print in the color mode;

if the beginning portion includes a color page, then:

(a) scheduling printing of the beginning portion of the print job to print in the full-color mode; and (b) scheduling a plurality of the remaining pages of the print job to print in the full-color mode, unless a threshold number of consecutive monochrome pages is detected in the remaining pages of the print job, in which case the consecutive monochrome pages are scheduled to be printed in the monochrome mode.

14. The printing method of claim 13, further comprising, it the print job is a duplex print job, then determining an optimization setting of the printing apparatus indicating whether the printing apparatus is set to optimize filling the duplex path.

15. The printing method of claim 14, further comprising, if the printing apparatus is set to optimize filling the duplex path, then determining whether any color exists in a next duplex path group.

16. The printing method of claim 15, further comprising, if color exists in the next duplex path group, scheduling printing of all pages in the next duplex path group in a full-color mode, otherwise, scheduling printing of all of the pages in the next duplex path group in the monochrome mode.

17. The printing method of claim 13, wherein the beginning portion is a first page of the print job.

18. A printing apparatus configured to print in a full-color mode and in a monochrome mode, the apparatus comprising:

a look-ahead queue configured to receive incoming pages of a print job; and a switching decision module configured to select a full-color mode or a monochrome mode for printing the pages of the print job;

wherein the switching decision module is configured to examine a portion of the print job in the look-ahead queue to determine whether the portion includes a color page, and if the portion includes a color page, to schedule a first page of the portion and one or more subsequent pages of the print job to print in a full-color mode, irrespective of the color content of the plurality of subsequent pages;

wherein if the portion does not include a color page, the switching decision module is configured to schedule printing of the portion in a monochrome mode, and if a subsequent color page is detected in a remaining portion of the print job, the switching decision module is configured to schedule printing of the subsequent color page in the full-color mode; and wherein if at least a threshold number of consecutive monochrome pages is detected in a remaining portion of the print job, the switching decision module is configured to schedule printing of the consecutive monochrome pages in the monochrome mode.

19. The printing apparatus of claim 18, wherein the portion is a first page of the print job.

20. The printing apparatus of claim 18, wherein the switching decision module is configured to schedule the portion end subsequent pages to print in a monochrome mode, if the portion does not include a color page.

21. A computer readable medium for use in a printing apparatus, the computer readable medium comprising instructions that upon execution by the printing apparatus implement a method, comprising:

examining a beginning portion of the print job to determine whether the beginning portion includes a color page;

if the beginning portion includes a color page, scheduling a first page and a plurality of subsequent pages of the print job to print in a full-color mode, irrespective of the color content of the plurality of subsequent pages, such that subsequent color pages and subsequent monochrome pages are both scheduled for printing in the full-color mode;

if the portion does not include a color page, scheduling printing of the portion in a monochrome mode, end if a subsequent color pace is detected in a remaining portion of the print job, scheduling printing of the subsequent color page in the full-color mode; and if at least a threshold number of consecutive monochrome pages is detected in a remaining portion of the print job, scheduling printing of the consecutive monochrome pages in the monochrome mode.

22. A printing method for printing a print job on a printing apparatus having a monochrome mode and a full-color mode, the method comprising:

examining a beginning portion of the print job to determine whether the beginning portion includes a color page, or includes only one or more monochrome pages;

if the beginning portion includes only one or more monochrome pages, then scheduling the beginning portion to print in the monochrome mode;

examining pages in a remainder portion of the print job to determine whether each page is a color page or a monochrome page;

detecting a color page in the remainder portion of the print job; and scheduling the color page and one or more subsequent pages in the remainder portion of the print job to print in the full-color mode, irrespective of the color content of the one or more subsequent pages; and determining that a threshold number of consecutive monochrome pages occur in the remainder portion of the print job; and scheduling the threshold number of consecutive monochrome pages for printing in the monochrome mode.

* * * * *